US007536950B2

(12) United States Patent
Oshima et al.

(10) Patent No.: US 7,536,950 B2
(45) Date of Patent: May 26, 2009

(54) STENCIL PRINTING SYSTEM WITH PRINT PRESSURE CONTROLLING MEANS

(75) Inventors: Kenji Oshima, Ami-machi (JP); Takashi Isozaki, Ami-machi (JP); Manabu Iwamoto, Ami-machi (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 12/075,205

(22) Filed: Mar. 10, 2008

(65) Prior Publication Data

US 2008/0168913 A1 Jul. 17, 2008

Related U.S. Application Data

(62) Division of application No. 10/545,457, filed as application No. PCT/JP03/16044 on Dec. 15, 2003, now abandoned.

(30) Foreign Application Priority Data

Feb. 12, 2003 (JP) ..... 2003-033688

(51) Int. Cl.
*B41F 13/18* (2006.01)

(52) U.S. Cl. ..... 101/116; 101/120; 101/484

(58) Field of Classification Search ..... 101/116, 101/119, 120, 118, 484; *B41L 13/18*
See application file for complete search history.

(56) References Cited

U.S. PATENT DOCUMENTS

| | | | | |
|---|---|---|---|---|
| 5,517,913 | A | 5/1996 | Oshio et al. | 101/119 |
| 6,095,040 | A * | 8/2000 | Ashikagaya et al. | 101/120 |
| 6,530,519 | B1 | 3/2003 | Suzuki | 235/375 |
| 7,171,895 | B2 * | 2/2007 | Oshima et al. | 101/116 |
| 7,430,961 | B2 * | 10/2008 | Iwamoto | 101/128.4 |

FOREIGN PATENT DOCUMENTS

| | | |
|---|---|---|
| JP | 6155882 | 6/1994 |
| JP | 2151473 | 6/1997 |
| JP | 9216449 | 8/1997 |

* cited by examiner

*Primary Examiner*—Leslie J Evanisko
(74) *Attorney, Agent, or Firm*—Thomas F. Presson; Matthew K. Ryan; Frommer Lawrence & Haug LLP

(57) ABSTRACT

To make the stencil printing at a stabilized density from the start of printing in a stencil printing where a plurality of kinds of inks different from each other in volatility and/or viscosity are used. Information representing the volatility and/or viscosity of ink is stored in a storage means of an ink container, while the stored information representing the volatility and/or viscosity of ink is read out, and at the same time, the ceasing time from interruption of printing to resumption of the same is measured, and the printing pressure is controlled according to the ceasing time and the information representing the volatility and/or viscosity of ink.

3 Claims, 11 Drawing Sheets

FIG.4

| CEASING TIME | 0 | 1 | 2 |
|---|---|---|---|
| NOT LESS THAN 0 HOURS TO LESS THAN 1 HOUR | NUMBER OF PULSES 1 | NUMBER OF PULSES 7 | NUMBER OF PULSES 13 |
| NOT LESS THAN 1 HOUR TO LESS THAN 3 HOURS | NUMBER OF PULSES 2 | NUMBER OF PULSES 8 | NUMBER OF PULSES 14 |
| NOT LESS THAN 3 HOURS TO LESS THAN 8 HOURS | NUMBER OF PULSES 3 | NUMBER OF PULSES 9 | NUMBER OF PULSES 15 |
| NOT LESS THAN 8 HOURS TO LESS THAN 12 HOURS | NUMBER OF PULSES 4 | NUMBER OF PULSES 10 | NUMBER OF PULSES 16 |
| NOT LESS THAN 12HOURS TO LESS THAN 24 HOURS | NUMBER OF PULSES 5 | NUMBER OF PULSES 11 | NUMBER OF PULSES 17 |
| 24 HOURS OR MORE | NUMBER OF PULSES 6 | NUMBER OF PULSES 12 | NUMBER OF PULSES 18 |

FIG.6

| WORKING ENVIRONMENTAL TEMPERATURE | CEASING TIME | 0 | 1 | 2 |
|---|---|---|---|---|
| LOWER THAN 10℃ | NOT LESS THAN 0 HOURS TO LESS THAN 1 HOUR | NUMBER OF PULSES 1 | NUMBER OF PULSES 7 | NUMBER OF PULSES 13 |
| | NOT LESS THAN 1 HOURS TO LESS THAN 3 HOURS | NUMBER OF PULSES 2 | NUMBER OF PULSES 8 | NUMBER OF PULSES 14 |
| | NOT LESS THAN 3 HOURS TO LESS THAN 8 HOURS | NUMBER OF PULSES 3 | NUMBER OF PULSES 9 | NUMBER OF PULSES 15 |
| | NOT LESS THAN 8 HOURS TO LESS THAN 12 HOURS | NUMBER OF PULSES 4 | NUMBER OF PULSES 10 | NUMBER OF PULSES 16 |
| | NOT LESS THAN 12 HOURS TO LESS THAN 24 HOURS | NUMBER OF PULSES 5 | NUMBER OF PULSES 11 | NUMBER OF PULSES 17 |
| | 24 HOURS OR MORE | NUMBER OF PULSES 6 | NUMBER OF PULSES 12 | NUMBER OF PULSES 18 |
| NOT LOWER THAN 10℃ TO LOWER THAN 15℃ | ⋮ | ⋮ | ⋮ | ⋮ |
| NOT LOWER THAN 15℃ TO LOWER THAN 20℃ | ⋮ | ⋮ | ⋮ | ⋮ |
| NOT LOWER THAN 20℃ TO LOWER THAN 25℃ | ⋮ | ⋮ | ⋮ | ⋮ |
| NOT LOWER THAN 25℃ TO LOWER THAN 30℃ | ⋮ | ⋮ | ⋮ | ⋮ |
| 30℃ OR HIGHER | ⋮ | ⋮ | ⋮ | ⋮ |

FIG.7

| WORKING ENVIRONMENTAL TEMPERATURE | CEASING TIME | 0 | 1 | 2 |
|---|---|---|---|---|
| LOWER THAN 10℃ | NOT LESS THAN 0 HOURS TO LESS THAN 1 HOUR | NUMBER OF COPIES 1 | NUMBER OF COPIES 7 | NUMBER OF COPIES 13 |
| | NOT LESS THAN 1 HOUR TO LESS THAN 3 HOURS | NUMBER OF COPIES 2 | NUMBER OF COPIES 8 | NUMBER OF COPIES 14 |
| | NOT LESS THAN 3 HOURS TO LESS THAN 8 HOURS | NUMBER OF COPIES 3 | NUMBER OF COPIES 9 | NUMBER OF COPIES 15 |
| | NOT LESS THAN 8 HOURS TO LESS THAN 12 HOURS | NUMBER OF COPIES 4 | NUMBER OF COPIES 10 | NUMBER OF COPIES 16 |
| | NOT LESS THAN 12 HOURS TO LESS THAN 24 HOURS | NUMBER OF COPIES 5 | NUMBER OF COPIES 11 | NUMBER OF COPIES 17 |
| | 24 HOURS OR MORE | NUMBER OF COPIES 6 | NUMBER OF COPIES 12 | NUMBER OF COPIES 18 |
| NOT LOWER THAN 10℃ TO LOWER THAN 15℃ | ⋮ | ⋮ | ⋮ | ⋮ |
| NOT LOWER THAN 15℃ TO LOWER THAN 20℃ | ⋮ | ⋮ | ⋮ | ⋮ |
| NOT LOWER THAN 20℃ TO LOWER THAN 25℃ | ⋮ | ⋮ | ⋮ | ⋮ |
| NOT LOWER THAN 25℃ TO LOWER THAN 30℃ | ⋮ | ⋮ | ⋮ | ⋮ |
| 30℃ OR HIGHER | ⋮ | ⋮ | ⋮ | ⋮ |

STENCIL PRINTING SYSTEM WITH PRINT PRESSURE CONTROLLING MEANS

This is a division of U.S. application Ser. No. 10/545,457, filed Aug. 12, 2005 now abandoned under 35 USC 371 from International Application PCT/JP03/16044 filed on Dec. 15, 2003, with a claim of priority under 35 USC 119 to Japanese Application 2003-33688, filed in Japan on Feb. 12, 2002, the entirety thereof being incorporated herein by reference.

FIELD OF THE INVENTION

This invention relates to a stencil printing method and system where a plurality of kinds of inks different from each other in volatility and/or viscosity are used, and an ink container and a stencil material roll for carrying out the stencil printing method.

BACKGROUND OF THE INVENTION

There have been proposed stencil printers where print is made by driving, for instance, a thermal head according to image data obtained by reading out an original by, for instance, a scanner to selectively melt and perforate stencil material to make a stencil, winding the stencil around a printing drum, supplying ink inside the printing drum, and transferring the ink to printing papers through the stencil by, for instance, a roller.

In the stencil printers described above, when the working environmental temperature changes, the viscosity of the ink changes and the amount of ink transferred to the printing papers through the stencil changes which makes it impossible to make stencil printing at a stabilized density. Accordingly, there has been proposed, in Japanese Unexamined Patent Publication No. 2 (1990)-151473, a method of stencil printing where the pressure of the roller against the printing drum is changed according to the working environmental temperature so that the amount of ink transferred to the printing papers is fixed to make it possible to make stencil printing at a stabilized density.

In the above-mentioned stencil printer, when printing is once interrupted and is resumed, for instance, the ink adhering to the inner side of the printing drum has been dried or the water content or solvent of the ink inside the printing drum evaporates to increase the viscosity of the ink, whereby the ink inside the printing drum becomes hard to be transferred to the printing papers, which reduces the printing density and/or fluctuates the printing density.

In order to avoid this problem, there has been proposed a method where the ceasing time from the preceding printing to resumption of the printing is measured, and the pressure of the roller against the printing drum is increased above that during usual printing according to the length of the measured ceasing time, thereby making it possible to make stencil printing at a stabilized density.

However, in the above-mentioned stencil printer, for instance, when a plurality of kinds of inks different from each other, for instance, in volatility are used, the viscosity of ink inside the printing drum upon start of printing can sometimes differ due to difference in volatility. Accordingly, if the printing pressure is controlled solely according to the length of the ceasing time, the printing density becomes up and down depending on the kind of ink employed, which makes it impossible to make stencil printing at a stabilized density. Further, when a plurality of kinds of inks different from each other in viscosity are used, the viscosity of ink inside the printing drum upon start of printing can sometimes differ and it is impossible to make stencil printing at a stabilized density as described above.

Further, when a stencil comprising thermoplastic film and a porous support sheet such as Japanese paper or non-woven fabric laminated with each other is used, the amount of ink transferred to the printing papers changes according to the kind of porous support sheet since the ink supplied inside the printing drum is transferred to the printing papers through the pores of the porous support sheet and the perforations formed in the thermoplastic film. The reason why the amount of ink transferred to the printing papers differs according to the kind of porous support sheet is that the void volume, the void size, the void structure, the thickness of the support sheet, the material of the support sheet and/or the wetting characteristics differ according to the kind of porous support sheet and the resistance when the ink passes through the pores and/or the thickness of the transferring ink film differ. Accordingly, when a plurality of kinds of stencils are used, it is necessary to empirically obtain the printing pressure by the kind of porous support sheet, and if the printing pressure is controlled solely according to the length of the ceasing time, it is impossible to make stencil printing at a stabilized density.

The object of the present invention is to provide a stencil printing method and system, an ink container, and a stencil material roll which permit the stencil printing to be made at a stabilized density from the start of printing even if a plurality of kinds of inks different from each other in volatility and/or viscosity are used and/or a plurality of kinds of stencils different from each other in the kind of porous support sheet are used in the above-mentioned stencil printer.

SUMMARY OF THE INVENTION

In accordance with the present invention, there is provided a first stencil printing method comprising, in methods where ink is supplied in a printing drum around which a stencil made is wound, a printing paper is pressed against the outer peripheral surface of the printing drum at a predetermined printing pressure, and stencil printing is made with the ink by rotating the printing drum at a predetermined rotational speed, the steps of measuring a ceasing time from interruption of printing to resumption of the same, obtaining information on the kind of ink, and controlling the printing pressure according to the ceasing time and the kind of ink.

The "ceasing time from interruption of printing to resumption of the same" means the time from the preceding printing to resumption of the printing and may be, for instance, the time from stop of the action of the printing drum to resumption of the same. Otherwise, the ceasing time from interruption of printing to resumption of the same may be the time from stop of the action of another part in the stencil printer to resumption of the same or the time from the time at which the power source of the stencil printer is turned off to the time at which it is turned on again.

The "kind of ink" may be any so long as it affects the permeability of ink to the printing drum and/or the stencil. For example, it includes those representing the volatility of the ink, the viscosity of the ink, and the characteristics of change of the viscosity of the ink, and it is preferred that it includes at least one of them.

The "information on the kind of ink" may be, when the kind of ink represents the volatility of the ink, the value of evaluation of the volatility or a letter or a symbol representing the value. When the kinds of ink are classified according to the range of the value of evaluation of the volatility, it may be the value representing the class which the ink belongs. Further, for instance, when the kind of ink represents the viscosity of the ink, it means information representing the viscosity of the ink before use and maybe either the viscosity itself or a letter or a symbol representing the viscosity or the value representing the class which the ink belongs when the kinds of ink are classified according to the range of the value of evaluation of the viscosity. Further, for instance, when the kind of ink represents the characteristics of change of the viscosity of the ink, it may be the value of evaluation of the characteristics of change of the viscosity of the ink or a letter or a symbol representing the value, or the value representing the class which the ink belongs when the kinds of ink are classified according to the range of the value of evaluation of the characteristics of change of the viscosity of the ink. Further when the kind of ink represents a combination of plurality of its volatility, viscosity, and characteristics of change of the viscosity, the value representing the class which the ink belongs when the kinds of ink are classified by the kinds of ink which resembles in the plurality of the characteristics can be used.

Further, the expression "controlling the printing pressure according to the ceasing time and the kind of ink" means, for instance, to increase the printing pressure as the volatility of the ink increases when the ceasing time and the viscosity of ink are the same, and to increase the printing pressure as the ceasing time increases when the volatility and the viscosity of ink are the same in the case where the kind of ink represents the volatility of ink. In the case where the kind of ink represents the viscosity of ink, it means to increase the printing pressure as the viscosity of the ink increases when the ceasing time and the volatility of ink are the same, and to increase the printing pressure as the ceasing time increases when the volatility and the viscosity of ink are the same. In the case where the kind of ink represents the characteristics of change of the viscosity of ink, it means to increase the printing pressure as the viscosity of the ink at the ceasing time increases when the ceasing time is the same, and to increase the printing pressure as the ceasing time increases when the characteristics of change of the viscosity of the ink is the same.

Further, in the first stencil printing method, the number of copies which are made at a printing pressure according to the ceasing time and the kind of ink may be set according to at least one of information on the ceasing time and information on the kind of ink.

The expression "the number of copies which are made is set according to at least one of information on the ceasing time and information on the kind of ink" means, for instance, to increase the number of copies as the volatility of the ink increases when the ceasing time and the viscosity of ink are the same, and to increase the number of copies as the ceasing time increases when the volatility and the viscosity of ink are the same in the case where the kind of ink represents the volatility of ink. In the case where the kind of ink represents the viscosity of ink, it means to increase the number of copies as the viscosity of the ink increases when the ceasing time and the volatility of ink are the same, and to increase the number of copies as the ceasing time increases when the volatility and the viscosity of ink are the same. In the case where the kind of ink represents the characteristics of change of the viscosity of ink, it means to increase the number of copies as the viscosity of the ink at the ceasing time increases when the ceasing time is the same, and to increase the number of copies as the ceasing time increases when the characteristics of change of the viscosity of the ink is the same.

In accordance with the present invention, there is further provided a second stencil printing method comprising, in methods where ink is supplied in a printing drum around which a stencil made is wound, a printing paper is pressed against the outer peripheral surface of the printing drum at a predetermined printing pressure, and stencil printing is made with the ink by rotating the printing drum at a predetermined rotational speed, the steps of measuring a ceasing time from interruption of printing to resumption of the same, obtaining information on the kind of ink, and controlling the rotational speed according to the ceasing time and the kind of ink.

Further, the expression "controlling the rotational speed according to the ceasing time and the kind of ink" means, for instance, to reduce the rotational speed as the volatility of the ink increases when the ceasing time and the viscosity of ink are the same, and to reduce the rotational speed as the ceasing time increases when the volatility and the viscosity of ink are the same in the case where the kind of ink represents the volatility of ink. In the case where the kind of ink represents the viscosity of ink, it means to reduce the rotational speed as the viscosity of the ink increases when the ceasing time and the volatility of ink are the same, and to reduce the rotational speed as the ceasing time increases when the volatility and the viscosity of ink are the same. In the case where the kind of ink represents the characteristics of change of the viscosity of ink, it means to reduce the rotational speed as the viscosity of the ink at the ceasing time increases when the ceasing time is the same, and to reduce the rotational speed as the ceasing time increases when the characteristics of change of the viscosity of the ink is the same.

Further, in the second stencil printing method, the number of copies which are made at a rotational speed according to the ceasing time and the kind of ink may be set according to at least one of information on the ceasing time and information on the kind of ink.

In accordance with the present invention, there is further provided a third stencil printing method comprising, in methods where ink is supplied in a printing drum around which a stencil made is wound, a printing paper is pressed against the outer peripheral surface of the printing drum at a predetermined printing pressure, and stencil printing is made with the ink by rotating the printing drum at a predetermined rotational speed, the steps of measuring a ceasing time from interruption of printing to resumption of the same, obtaining information on the kind of stencil, and controlling the printing pressure according to the ceasing time and the kind of stencil.

The "kind of stencil" may be any so long as it represents permeability of the porous support sheet to ink. For example, it includes those representing the void volume, the void size, the void structure, the thickness, the material and/or the wetting characteristics of the porous support sheet, and it is preferred that it includes at least one of them. The void volume refers to the proportion of the areas of the pores per unit area of the support sheet, the void structure refers to the shape of the thin tube forming the pore, and the wetting characteristics of the porous support sheet refers to spread of ink on the porous support sheet. The material of the porous support sheet includes, for instance, natural fibers such as of wood and of non-wood; and synthetic fibers or film such as of nylon, of polyester and of acryl.

The "information on the kind of stencil" may be, either the kind of stencil itself or a letter or a symbol representing the kind of stencil or the value representing the class which the stencil belongs when the kinds of stencils are classified according to the kind of porous support sheet.

Further, the expression "controlling the printing pressure according to the ceasing time and the kind of stencil" means, for instance, to reduce the printing pressure as the void volume of the porous support sheet increases when the ceasing time is the same in the case where the kind of the porous support sheet represents the void volume since as the void volume of the porous support sheet increases, the amount of ink transferred to the printing paper increases. In the case where the kind of the porous support sheet represents the void size, it means to reduce the printing pressure as the void size of the porous support sheet increases since as the void size of the porous support sheet increases, the amount of ink transferred to the printing paper increases. In the case where the kind of the porous support sheet represents the thickness of the porous support sheet, it means to increase the printing pressure as the thickness of the porous support sheet increases since as the thickness of the porous support sheet increases, the amount of ink transferred to the printing paper reduces. In the case where the kind of the porous support sheet represents the wetting characteristics of the porous support sheet, it means to increase the printing pressure as the wetting of the porous support sheet becomes worse since as the wetting of the porous support sheet becomes worse, the amount of ink transferred to the printing paper reduces. Further, in the case where the kind of the porous support sheet represents the material or the void structure of the porous support sheet, the printing pressure may be controlled to a printing pressure empirically obtained through an experiment which has been done in advance using stencils different from each other in those factors. In the case where the kind of stencil is the same, it means to increase the printing pressure as the ceasing time increases.

Further, in the third stencil printing method, the number of copies which are made at a printing pressure according to the ceasing time and the kind of stencil may be set according to at least one of information on the ceasing time and information on the kind of stencil.

The expression "the number of copies which are made is set according to at least one of information on the ceasing time and information on the kind of stencil" means, for instance, to reduce the number of copies as the void volume of the porous support sheet increases when the ceasing time is the same in the case where the kind of the porous support sheet represents the void volume. In the case where the kind of the porous support sheet represents the void size, it means to reduce the number of copies as the void size of the porous support sheet increases. In the case where the kind of the porous support sheet represents the thickness of the porous support sheet, it means to increase the number of copies as the thickness of the porous support sheet increases. In the case where the kind of the porous support sheet represents the wetting characteristics of the porous support sheet, it means to increase the number of copies as the wetting of the porous support sheet becomes worse. Further, in the case where the kind of the porous support sheet represents the material or the void structure of the porous support sheet, the number of copies may be controlled to a number of copies empirically obtained through an experiment which has been done in advance using stencils different from each other in those factors. In the case where the kind of stencil is the same, it means to increase the number of copies as the ceasing time increases.

In accordance with the present invention, there is further provided a fourth stencil printing method comprising, in methods where ink is supplied in a printing drum around which a stencil made is wound, a printing paper is pressed against the outer peripheral surface of the printing drum at a predetermined printing pressure, and stencil printing is made with the ink by rotating the printing drum at a predetermined rotational speed, the steps of measuring a ceasing time from interruption of printing to resumption of the same, obtaining information on the kind of stencil, and controlling the rotational speed according to the ceasing time and the kind of stencil.

The expression "controlling the rotational speed according to the ceasing time and the kind of stencil" means, for instance, to increase the rotational speed as the void volume of the porous support sheet increases when the ceasing time is the same in the case where the kind of the porous support sheet represents the void volume since as the void volume of the porous support sheet increases, the amount of ink transferred to the printing paper increases. In the case where the kind of the porous support sheet represents the void size, it means to increase the rotational speed as the void size of the porous support sheet increases since as the void size of the porous support sheet increases, the amount of ink transferred to the printing paper increases. In the case where the kind of the porous support sheet represents the thickness of the porous support sheet, it means to reduce the rotational speed as the thickness of the porous support sheet increases since as the thickness of the porous support sheet increases, the amount of ink transferred to the printing paper reduces. In the case where the kind of the porous support sheet represents the wetting characteristics of the porous support sheet, it means to reduce the rotational speed as the wetting of the porous support sheet becomes worse since as the wetting of the porous support sheet becomes worse, the amount of ink transferred to the printing paper reduces. Further, in the case where the kind of the porous support sheet represents the material or the void structure of the porous support sheet, the rotational speed may be controlled to a rotational speed empirically obtained through an experiment which has been done in advance using stencils different from each other in those factors. In the case where the kind of stencil is the same, it means to increase the printing pressure as the ceasing time increases.

Further, in the fourth stencil printing method, the number of copies which are made at a rotational speed according to the ceasing time and the kind of stencil may be set according to at least one of information on the ceasing time and information on the kind of stencil.

In accordance with the present invention, there is further provided a first stencil printing system comprising a printing drum rotating at a predetermined speed with a stencil made wound therearound and a pressing means which presses the printing papers against the outer peripheral surface of the printing drum, thereby making stencil printing with ink by supplying the ink in the printing drum, pressing the printing paper against the printing drum with the stencil made wound therearound at a predetermined printing pressure by the pressing means and rotating the printing drum at a predetermined rotational speed, wherein the improvement comprises a ceasing time measuring means which measures a ceasing time from interruption of printing to resumption of the same, an ink kind obtaining means which obtains information on the kind of ink, and a printing pressure controlling means which controls the printing pressure of the pressing means according to the ceasing time and the kind of ink.

Further, the first stencil printing system may be provided with a copy number setting means which sets the number of copies which are made at a printing pressure according to the ceasing time and the kind of ink according to information on the ceasing time and information on the kind of ink.

In accordance with the present invention, there is further provided a second stencil printing system comprising a printing drum rotating at a predetermined speed with a stencil made wound therearound and a pressing means which presses the printing papers against the outer peripheral surface of the printing drum, thereby making stencil printing with ink by supplying the ink in the printing drum, pressing the printing paper against the printing drum with the stencil made wound therearound at a predetermined printing pressure by the pressing means and rotating the printing drum at a predetermined rotational speed, wherein the improvement comprises a ceasing time measuring means which measures a ceasing time from interruption of printing to resumption of the same, an ink kind obtaining means which obtains information on the kind of ink, and a rotational speed controlling means which controls the rotational speed of the printing drum according to the ceasing time and the kind of ink.

Further, the second stencil printing system may be provided with a copy number setting means which sets the number of copies which are made at a rotational speed according to the ceasing time and the kind of ink according to information on the ceasing time and information on the kind of ink. In accordance with the present invention, there is further provided a third stencil printing system comprising a printing drum rotating at a predetermined speed with a stencil made wound therearound and a pressing means which presses the printing papers against the outer peripheral surface of the printing drum, thereby making stencil printing with ink by supplying the ink in the printing drum, pressing the printing paper against the printing drum with the stencil made wound therearound at a predetermined printing pressure by the pressing means and rotating the printing drum at a predetermined rotational speed, wherein the improvement comprises a ceasing time measuring means which measures a ceasing time from interruption of printing to resumption of the same, a stencil kind obtaining means which obtains information on the kind of stencil, and a printing pressure controlling means which controls the printing pressure of the pressing means according to the ceasing time and the kind of stencil.

Further, the third stencil printing system may be provided with a copy number setting means which sets the number of copies which are made at a printing pressure according to the ceasing time and the kind of stencil according to at least one of information on the ceasing time and information on the kind of stencil.

In accordance with the present invention, there is further provided a fourth stencil printing system comprising a printing drum rotating at a predetermined speed with a stencil made wound therearound and a pressing means which presses the printing papers against the outer peripheral surface of the printing drum, thereby making stencil printing with ink by supplying the ink in the printing drum, pressing the printing paper against the printing drum with the stencil made wound therearound at a predetermined printing pressure by the pressing means and rotating the printing drum at a predetermined rotational speed, wherein the improvement comprises a ceasing time measuring means which measures a ceasing time from interruption of printing to resumption of the same, a stencil kind obtaining means which obtains information on the kind of stencil, and a rotational speed controlling means which controls the rotational speed of the printing drum according to the ceasing time and the kind of stencil.

Further, the fourth stencil printing system may be provided with a copy number setting means which sets the number of copies which are made at a rotational speed according to the ceasing time and the kind of ink according to at least one of information on the ceasing time and information on the kind of stencil.

In accordance with the present invention, there is further provided a first ink container which is employed to carry out the first and second stencil printing methods and comprises a storage means for storing the kind of ink in the ink container.

In accordance with the present invention, there is further provided a stencil material roll which comprises stencil materials employed to carry out the third and fourth stencil printing methods rolled into a roll and a storage means for storing information representing the kind of stencil.

In accordance with the first and second stencil printing methods and systems of the present invention, since the ceasing time from interruption of printing to resumption of the same is measured and the information on the kind of ink is obtained so that the printing pressure of the pressing means or the rotational speed of the printing drum is controlled according to the ceasing time and the kind of ink, the stencil printing can be made at a stabilized density from the start of printing even if a plurality of kinds of inks are used in the stencil printer by making the stencil printing at a printing pressure or a rotational speed taking into account both the difference in the kind of ink and the length of the ceasing time.

Further, when the number of copies which are made at a printing pressure or the rotational speed according to the ceasing time and the kind of ink is set according to information on the ceasing time and information on the kind of ink in the first and second stencil printing methods and systems of the present invention, the stencil printing is made at a printing pressure or a rotational speed according to the ceasing time and the kind of ink only when the amount of ink transferred to the printing papers from the inside of the printing drum is not stabilized by making print at a usual printing pressure or a usual rotational speed after the copies are made in the number thus set, and a situation where the printing pressure is increased in vain or the rotational speed is reduced in vain when the amount of ink transferred to the printing papers from the inside of the printing drum is stabilized can be avoided.

In accordance with the third and fourth stencil printing methods and systems of the present invention, since the ceasing time from interruption of printing to resumption of the same is measured and the information on the kind of stencil is obtained so that the printing pressure of the pressing means or the rotational speed of the printing drum is controlled according to the ceasing time and the kind of stencil, the stencil printing can be made at a stabilized density from the start of printing even if a plurality of kinds of stencils are used in the stencil printer by making the stencil printing at a printing pressure or a rotational speed taking into account both the difference in the kind of stencil and the length of the ceasing time.

Further, when the number of copies which are made at a printing pressure or the rotational speed according to the ceasing time and the kind of stencil is set according to information on the ceasing time and information on the kind of stencil in the third and fourth stencil printing methods and systems of the present invention, the stencil printing is made at a printing pressure or a rotational speed according to the ceasing time and the kind of stencil only when the amount of ink transferred to the printing papers from the inside of the printing drum is not stabilized by making print at a usual printing pressure or a usual rotational speed after the copies are made in the number thus set, and a situation where the printing pressure is increased in vain or the rotational speed is reduced in vain when the amount of ink transferred to the printing papers from the inside of the printing drum is stabilized can be avoided.

Since the ink container of the present invention is provided with the storage means which stores information on the kind of ink, the information can be automatically obtained by reading out the information on the kind of ink from the storage means. Further, for instance, when information such as a parameter representing a printing pressure or a rotational speed according to the kind of ink is stored in the storage means as well as the information on the kind of ink, the above information can be obtained from the storage means and the above control of the printing pressure or the rotational speed can be effected even if the kind of ink which has not been set in the stencil printer is employed.

Since the stencil material roll of the present invention is provided with the storage means which stores information on the kind of stencil the information can be automatically obtained by reading out the information on the kind of stencil from the storage means. Further, for instance, when information such as a parameter representing a printing pressure or a rotational speed according to the kind of stencil is stored in the storage means as well as the information on the kind of stencil, the above information can be obtained from the storage means and the above control of the printing pressure or the rotational speed can be effected even if the kind of stencil which has not been set in the stencil printer is employed.

BRIEF DESCRIPTION OF THE DRAWINGS

FIG. 4 is a printing pressure changing table which the printing pressure control means shown in FIG. 2 has, FIG. 6 is a printing pressure changing table which the printing pressure control means shown in FIG. 5 has, FIG. 7 is a copy number changing table which the copy number setting means has.

PREFERRED EMBODIMENTS OF THE INVENTION

Figure 1:
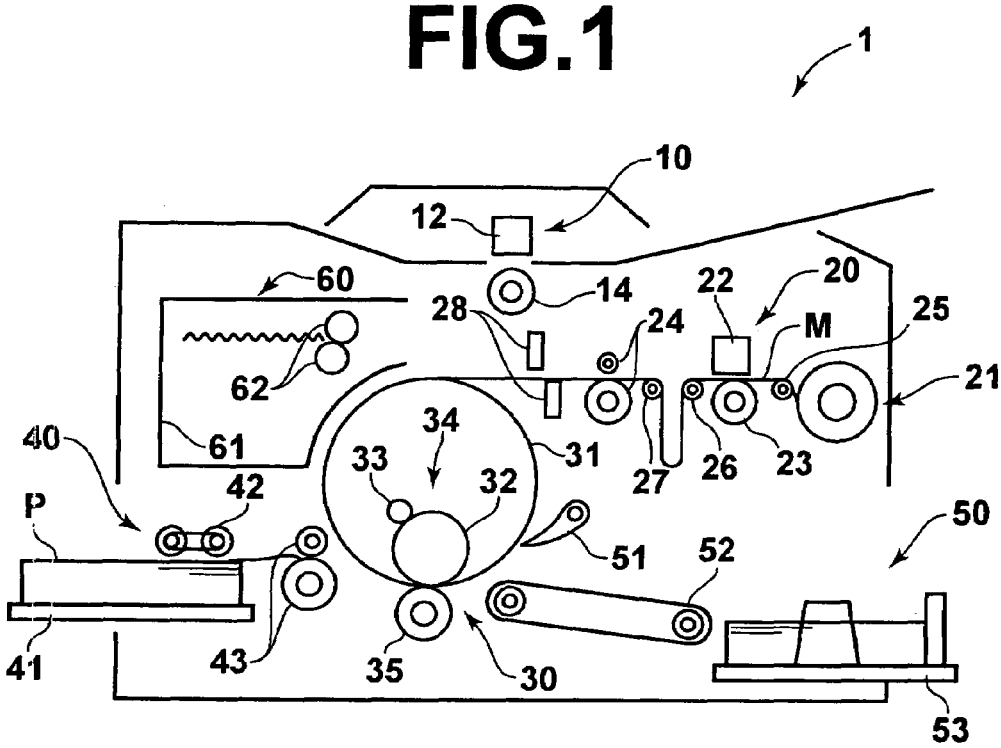
FIG. 1 is a view showing in brief a stencil printer in accordance with a first embodiment of the present invention.

A stencil printer in accordance with a first embodiment of the present invention will be described, hereinbelow, with reference to the drawings. FIG. 1 is a view showing in brief the stencil printer.

As shown in FIG. 1, the stencil printer 1 comprises a reading portion 10 which reads out an image on an original, a stencil making portion 20 which makes a stencil M from stencil material on the basis of the image information read by the reading portion 10, a printing portion 30 which prints on a printing paper by the use of the stencil made by the stencil making portion 20, a paper supply portion 40 which supplies the printing paper to the printing portion 30, a paper discharge portion 50 which discharges the printed printing paper, and a stencil discharge portion 60 which discharges the stencil M after use.

The image read-out portion 10 is an image scanner and comprises an image line sensor 12 which reads out an image on an original conveyed in a sub-scanning direction, and original feed rollers 14.

The stencil making portion 20 comprises a stencil material roll portion 21, a stencil making unit 22 having a thermal head where plurality of heater elements are arranged in a row, stencil material feed rollers 23 and 24, stencil material guide rollers 25, 26 and 27, and a stencil cutter 28.

The printing portion 30 comprises a cylindrical ink-transmittable printing drum 31 which is formed of a porous metal plate or a mesh structure, an ink supply system 34 having a squeegee roller 32, a doctor roller 33 and an ink supply pump 36 (See FIG. 2) which are disposed in the printing drum 31, and a press roller 35. The stencil M is wound around outer periphery of the printing drum 31.

Figure 2:
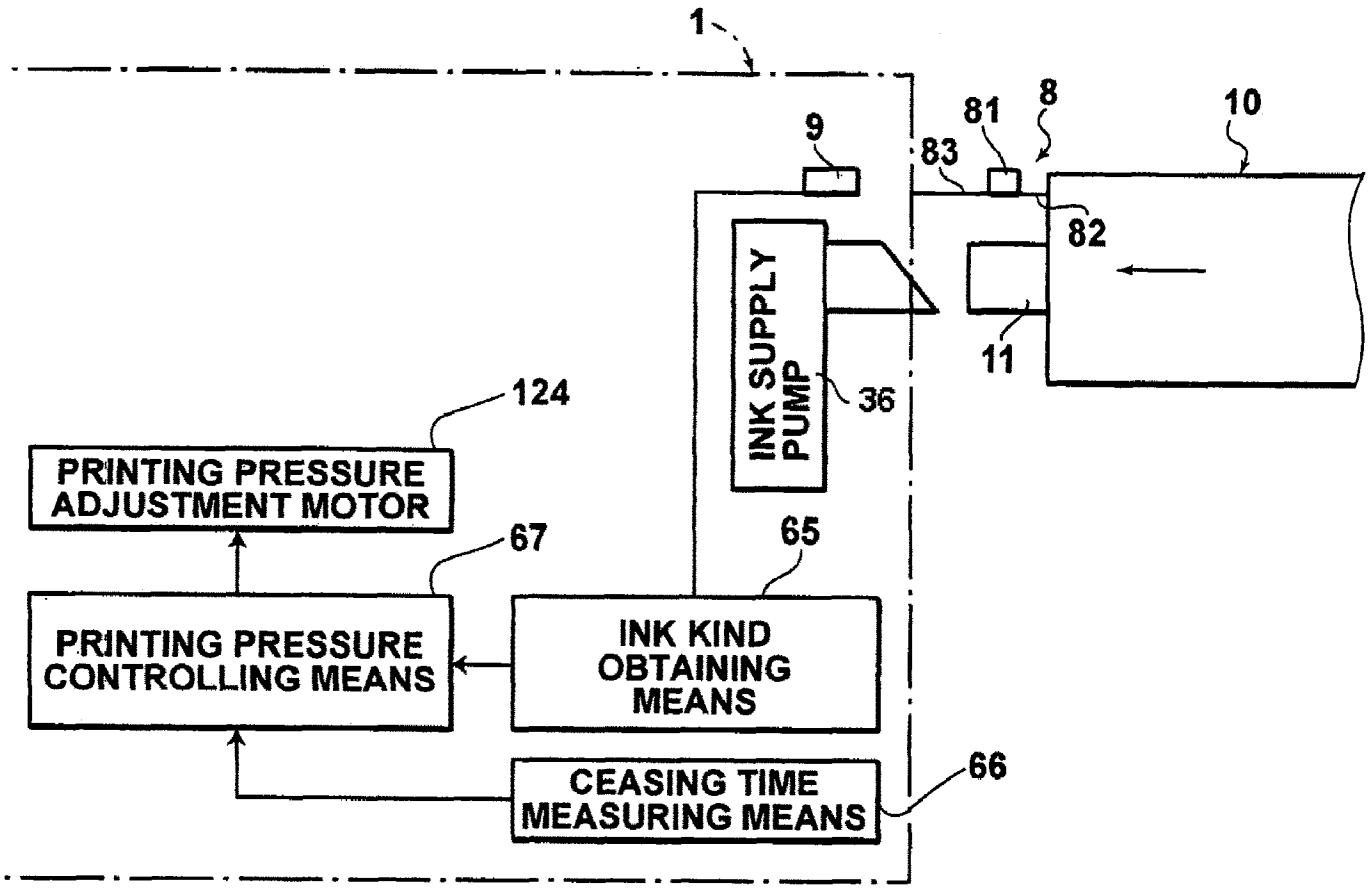
FIG. 2 is a block diagram showing a part of the stencil printer shown in FIG. 1.

The ink container 10 in which ink to be used in the printing portion 30 is provided at its leading end with an opening 11 through which the ink is discharged as shown in FIG. 2. The opening 11 is connected to an ink supply pump 35 disposed inside the printing drum 31. The ink container 10 is provided at its leading end portion a storage means 8 which stores information representing the volatility and the viscosity of ink in the ink container 10. The storage means 8 comprises a memory IC 81 forming a non-volatile memory (e.g., an EEPROM) which can hold data for a predetermined time without power supply, and a contact 83 is provided on the tip of a board 82 on which the memory IC 81 is mounted.

Further, as shown in FIG. 2, a connector 9 which is to be electrically connected to the contact 83 of the storage means 8 of the ink container 10 is provided near the ink supply pump 35 of the stencil printer 1. And the connector 9 and an ink kind obtaining means are connected to each other so that the information representing the volatility and the viscosity of the ink is read out by the ink kind obtaining means.

In the stencil printer 1, ink in a predetermined color is supplied inside the printing drum 31 by an ink supply system 34. As the printing drum 31 is rotated in the counterclockwise direction as seen in FIG. 1 about its central axis by a drive means not shown, a printing paper P is moved left to right as seen in FIG. 1 by timing rollers 43 to be supplied between the printing drum 31 and the press roller 35 at a predetermined timing in synchronization with the rotation of the printing drum 31. The printing paper P is subsequently pressed by the press roller 35 against the stencil M on the outer peripheral surface of the printing drum 31, whereby the printing paper P is printed with the ink in the predetermined color.

Figure 3:
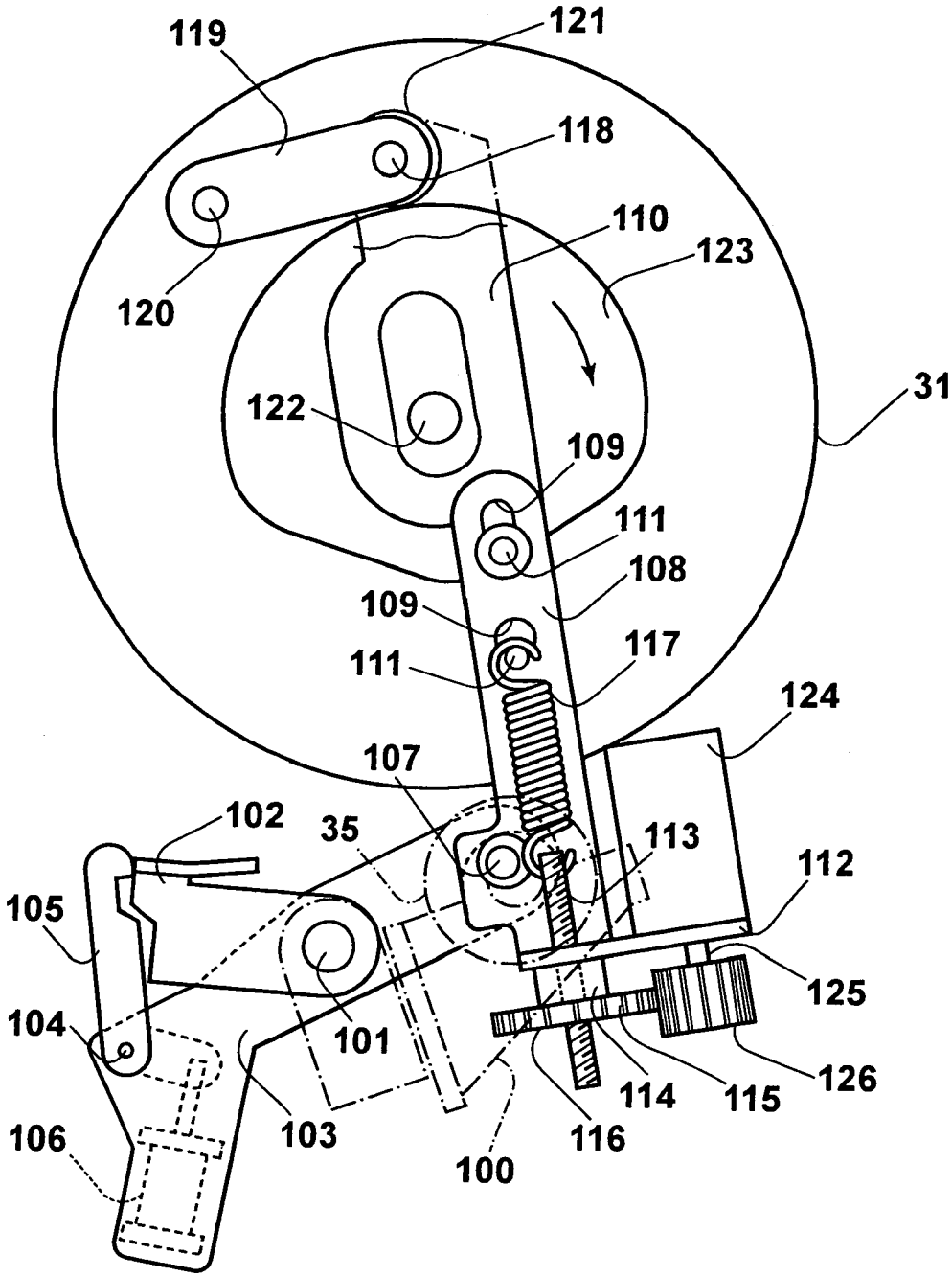
FIG. 3 is a view showing in brief the drive mechanism of the press roller of the stencil printer shown in FIG. 1.

FIG. 3 shows a drive mechanism of the press roller 35. The press roller 35 extends in the central axis of the printing drum 31 and supported by a bracket 100 for rotation about its central axis, The bracket 100 is fixedly mounted on a press shaft 101 supported for rotation by a frame which is a fixed side member and is not shown. In this manner, the press roller 35 can be swung substantially up and down about the press shaft 101 and is movable between a retracted position where it is away from the outer periphery of the printing drum 31 and a pressing position where it is pressed against the outer periphery of the printing drum 31.

A press drive lever 102 is fixedly mounted on the press shaft 101, which supports for rotation a press drive plate 103. A hook member 105 is mounted for rotation on the press drive plate 103 by a pivot 104. The hook member 105 is rotated by a solenoid 106 on the press drive plate 103 to be selectively engaged with the press drive lever 102, thereby drivingly jointing the press drive lever 102 and the press drive plate 103. An end of a first link member 108 is connected for rotation to the end portion of the press drive plate 103 by a pivot 107.

A pair of elongated holes 109 are formed at a pair of places of the first link member 108 to extend in the same direction, and a pair of pins 111 of a second link member 110 are respectively engaged with the elongated holes 109. With this arrangement, the first and second link members 108 and 110 are connected to each other to be displaceable in the longitudinal directions of the first and second link members 108 and 110, that is, in the up- and down-direction as seen in FIG. 3.

A folded flange piece portion 112 is provided in the lower end portion of the first link member 108 and an adjust screw 113 extends through the folded flange piece portion 112 to be movable in a direction in which the first link member 108 is moved back and forth. A nut member 116 in the form of a spur gear having external gear teeth 115 to bear thrust is in mesh with the adjust screw 113 in a position lower than the folded flange piece portion 112 by way of a collar 114 and one end of a tensile coiled spring 117 is engaged with the upper end portion of the adjust screw 113. The adjust screw 113 is inhibited from being rotated by the tensile coiled spring 117 on end of which is engaged with the adjust screw 113, and moves in the axial direction in response to rotation of the nut member 116. The tensile coiled spring 117 is engaged with the pin 111 at the other end and urges upward the first link member 108 with respect to the second link member 110, or in other words, urges the press drive plate 103 about the press shaft 101 in the counterclockwise direction as seen in FIG. 3 or in a direction in which the press roller 35 is pressed against the outer peripheral surface of the printing drum 31.

The second link member 110 is pivoted to the leading end portion of a cam lever 119 by a pivot 118 at its upper end portion. The cam lever 119 us supported for rotation on a frame (not shown) by a support shaft 120 and supports for rotation at the leading end portion thereof a cam follower roller 121 by way of the pivot 118. The cam follower roller 121 is in engagement with a press cam 123 mounted on a main shaft 122. The press cam 123 rotates in synchronization with the printing drum 31 and has a cam profile which positions the press roller 35 in a retracted position when a stencil clamp portion (not shown) provided on the outer periphery of the printing drum 31 is in the rotational position corresponding to the press roller 35 to avoid interference of the press roller 35 and the stencil clamp portion.

A printing pressure adjustment electric motor 124 is mounted on the folded flange piece portion 112 and an output shaft 125 of the printing pressure adjustment electric motor 124 is provided with a drive gear 126 which is fixedly mounted thereon. The drive gear 126 is in mesh with the external gear teeth 115 of the nut member 116 to transmit rotation of the output shaft of the printing pressure adjustment electric motor 124 to the nut member 116. In this press roller drive mechanism, the press cam 123 rotates in the clockwise direction as seen in FIG. 3 in response to the rotation of the printing drum 31, and the second link member 110 is moved up and down by the rotation of the press cam 123. The back-and-down movement of the second link member 110 is transmitted to the first link member 108 by the tensile coiled spring 117. The press drive plate 103 is rotated back and forth about the press shaft 101 by the translation of the first link member 108. Since the hook member 105 is in its engagement portion and in mesh with the press drive lever 102 by the solenoid 106, the back-and-forth rotation of the press drive plate 103 is transmitted to the press shaft 101. The back-and-forth rotation of the press shaft 101 swings up and down the press roller 35 about the press shaft 101 to move the press roller 35 between the retracted position where it is away from the outer periphery of the printing drum 31 and the pressing position where it is pressed against the outer periphery of the printing drum 31. In response to the movement of the press roller 35 to the pressing position, the second link member 110 is lifted and this movement is transmitted to the first link member 108 while providing the tensile coiled spring 117 with tensile force, and the press drive plate 103 is rotated in the counterclockwise direction as seen in FIG. 3 about the press shaft 101, whereby the press roller 35 is pressed against the outer periphery of the printing drum 31 intervening therebetween the printing paper P and rotation of the press drive plate 103 in the counterclockwise direction as seen in FIG. 3 about the press shaft 101 is thereby limited. In response to the second link member 110 further lifted, the second link member 110 is displaced with respect to the first link member 108 and the tensile coiled spring 117 is stretched. As a result, the press roller 35 is pressed against the outer periphery of the printing drum 31 intervening therebetween the printing paper P and the printing pressure comes to be governed by the force of the tensile coiled spring 117.

When the printing pressure is to be adjusted, the printing pressure adjustment electric motor 124 is driven and the drive gear 126 is rotated. Rotation of the drive gear 126 is transmitted to the nut member 116, and rotation of the nut member 116 moves the adjust screw 113 with respect to the first link member 108 in the axial direction to change the position of the adjust screw 113 in the axial direction with respect to the first link member 108. By this, the engagement portion of the tensile coiled spring 117 and the adjustment screw 113 is displaced in the axial direction with respect to the first link member 108 and the mounting length of the tensile coiled spring 117 is changed to change the mounting load thereof. When the mounting load of the tensile coiled spring 117 is changed, the pressure at which the press roller 35 is pressed against the printing drum 31 under the above-mentioned operation, that is, the printing pressure is changed.

The paper supply portion 40 comprises a paper supply table 41 on which printing papers P are stacked, a pick-up roller 42 which takes out the printing papers P one by one from the paper supply table 41, and a pair of timing rollers 43 which sends the printing paper P between the printing drum 31 and the press roller 35.

The paper discharge portion 50 comprises a separator 51 which peels off printed printing paper Q from the printing drum 31, a paper discharge belt portion 52, a paper discharge table 53 on which the printed printing papers Q are stacked.

The stencil discharge portion 60 comprises a stencil discharge box 61 in which the stencil M peeled off the printing drum 31 after use is placed, a pair of discharge stencil rollers 62 which peel the stencil M off the printing drum 31 after use and convey it to the stencil discharge box 61.

As shown in FIG. 2, the stencil printer 1 further comprises an ink kind obtaining means 65 which obtains information on the volatility and viscosity of ink from the storage means 8 provided on the ink container 10, a ceasing time measuring means 66 which measures a ceasing time from interruption of printing to resumption of the same, and a printing pressure controlling means 67 which controls the printing pressure of the press roller 35 against the printing drum 31 by controlling the printing pressure adjustment electric motor 124 according to the volatility and viscosity of ink obtained by the ink kind obtaining means 65 and the ceasing time. A printing pressure changing table such as shown in FIG. 4 is stored in the printing pressure controlling means 67. As shown in FIG. 4, in the printing pressure changing table, a number of drive pulses of the printing pressure adjustment electric motor 124 can be obtained on the basis of information 0-2 representing the volatility and viscosity of the ink in the ink container 10 and the ceasing time. The information 0-2 representing the volatility and viscosity of the ink is a value representing the class which the ink belongs when the ink are empirically classified in advance according to the volatility and the viscosity thereof, and one of the values 0 to 2 representing the class of the ink is stored in the storage means 8 of the ink container 10. The printing speed is set in advance by the operator of the system. In the printing pressure changing table, the number of the drive pulses is increased so that the pressure at which the press roller 35 is pressed against the printing drum 31 is increased as the volatility and the viscosity of the ink increase for a given ceasing time. Further, the number of the drive pulses is increased so that the pressure at which the press roller 35 is pressed against the printing drum 31 is increased as the ceasing time increases for a given value of the classification. Though, in this particular embodiment, the numbers of drive pulses are set in the printing pressure changing table, the numbers of drive pulses for standard ink may be set in advance while ratios to be multiplied or values to be added to or subtracted from the standard value are set in the printing pressure changing table.

Operation of the stencil printer 1 will be described, hereinbelow.

A stencil material roll is first mounted on a master holder and the stencil material M is unrolled from the stencil material roll in the length of one stencil which has been set in advance. Then, in the stencil making portion 20, a plurality of heater elements of the thermal head 22 are selectively energized to thermally perforate the stencil material M, thereby making a stencil. The stencil is cut by the cutter 28 and is wound around the printing drum 31.

The ink container 10 is installed in the ink supply pump 35 of the ink supply system 34, whereby the contact 83 of the storage means 8 is electrically connected to the connector 9, and the value of the classification stored in the storage means 8 are read out and input into the printing pressure controlling means 67 by the ink kind obtaining means 65. Further, a ceasing time measured by the ceasing time measuring means 66 is input into the printing pressure controlling means 67. The printing pressure controlling means 67 obtains a number of drive pulses by referring to the printing pressure changing table on the basis of the value of the classification and the ceasing time, and outputs the number of drive pulses into the printing pressure adjustment electric motor 124. The printing pressure adjustment electric motor 124 is driven on the basis of the number of drive pulses input to control the printing pressure at which the press roller 35 is pressed against the printing drum 31.

By the ink supply system 34, ink of a predetermined color is supplied inside the printing drum 31. As the printing drum 31 is rotated in the counterclockwise direction as seen in FIG. 1 about its central axis by a drive means not shown, a printing paper P is moved left to right as seen in FIG. 1 by timing rollers 43 to be supplied between the printing drum 31 and the press roller 35 at a predetermined timing in synchronization with the rotation of the printing drum 31. The printing paper P is subsequently pressed by the press roller 35 against the stencil M on the outer peripheral surface of the printing drum 31, whereby the printing paper P is printed with the ink in the predetermined color.

In accordance with the stencil printer 1 of the first embodiment of the present invention, since the ceasing time from interruption of printing to resumption of the same is measured and the information on the kind of ink is obtained so that the printing pressure of the press roller 35 is controlled according to the ceasing time and the kind of ink, the stencil printing can be made at a stabilized density from the start of printing even if a plurality of kinds of inks are used in the stencil printer by making the stencil printing at a printing pressure or a rotational speed taking into account both the difference in the kind of ink and the length of the ceasing time.

Figure 5:
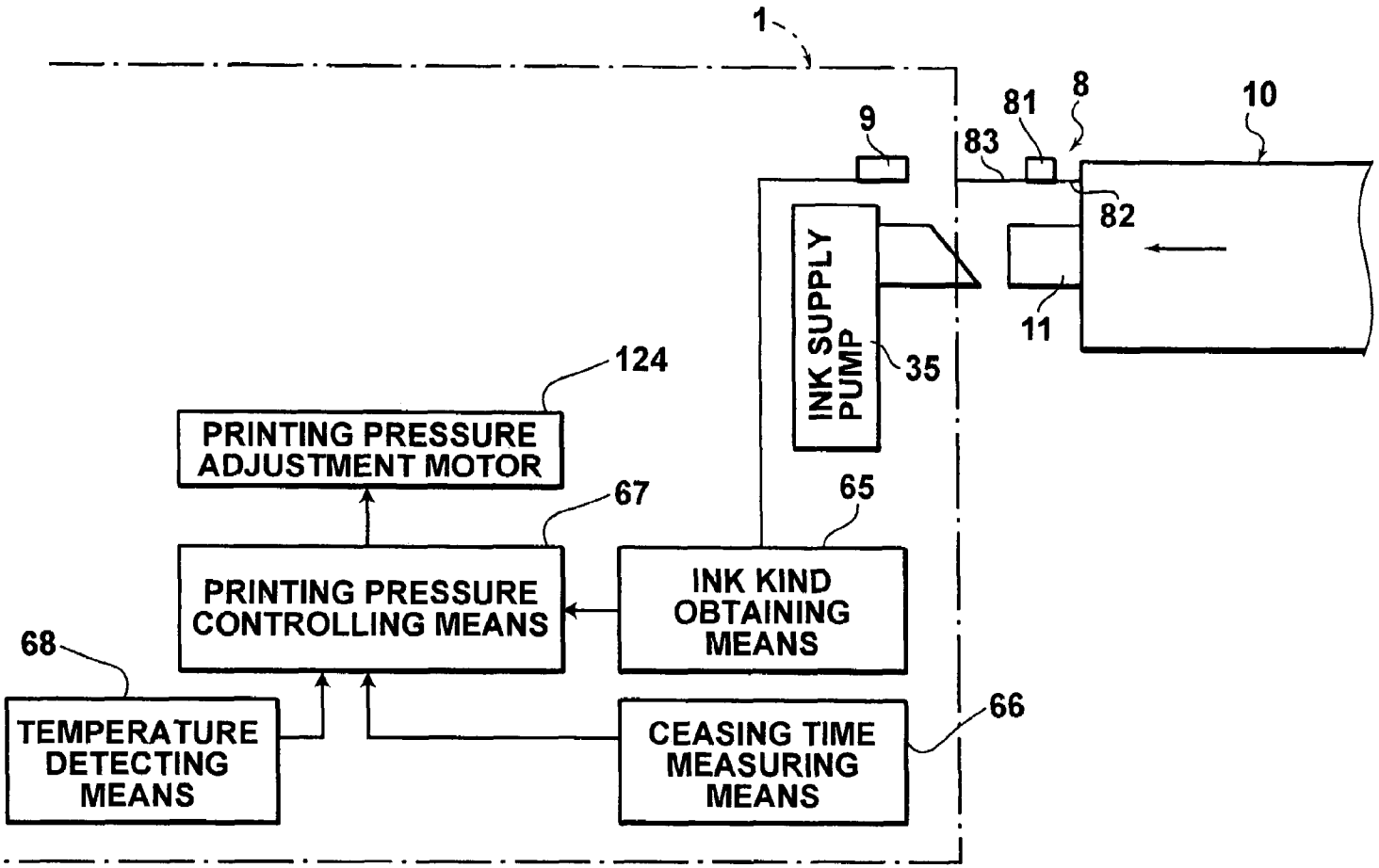
FIG. 5 is a block diagram showing a part of the stencil printer in accordance with a first embodiment of the present invention.

Further, in the stencil printer 1 of the first embodiment of the present invention, it is possible to provide a temperature detecting means 68 which detects the working environmental temperature as shown in FIG. 5 and to store in the printing pressure controlling means 67 a printing pressure changing table such as shown in FIG. 6 on the basis of which a printing pressure can be determined according to the working environmental temperature, the ceasing time and the value of classification so that the printing pressure controlling means 67 obtains a number of drive pulses according to the working environmental temperature detected by the temperature detecting means 68, the ceasing time and the value of classification and the printing pressure adjustment electric motor 124 is driven on the basis of the number of drive pulses. Further, when the ceasing time and the value of classification are the same, since the viscosity of ink increases and the amount ink transferred to the printing paper P is reduced as the working environmental temperature is lowered, the printing pressure changing table is set so that the number of drive pulses is increased and the printing pressure is increased as the working environmental temperature lowers.

Figure 8:
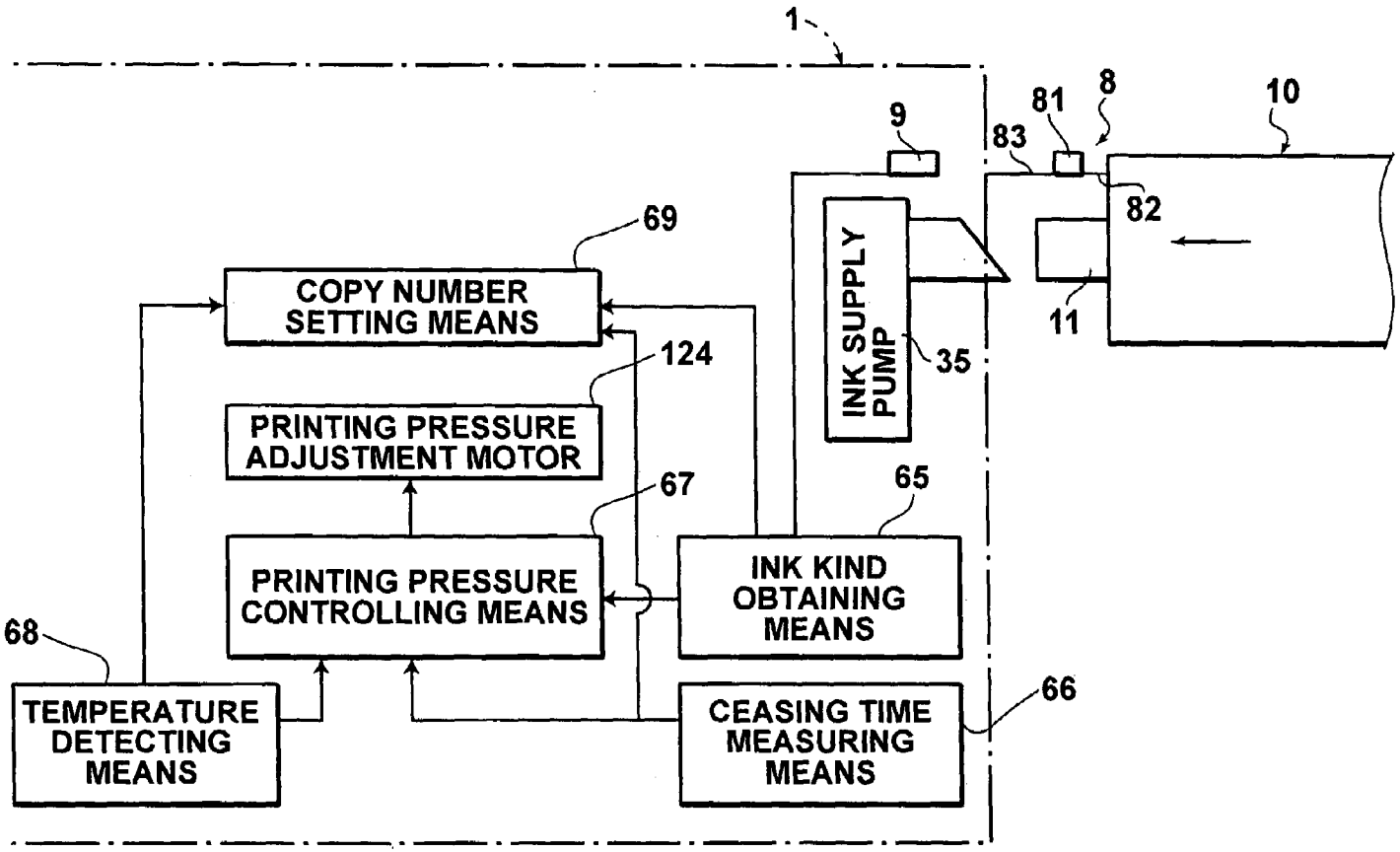
FIG. 8 is a block diagram showing a part of the stencil printer in accordance with a first embodiment of the present invention.

Further, in the stencil printer 1 of the first embodiment of the present invention, it is possible to provide a copy number setting means 69 (FIG. 8) which stores a copy number changing table such as shown in FIG. 7 on the basis of which a number of copies to be printed can be determined according to the working environmental temperature, the ceasing time and the value of classification so that the number of copies to be printed at the printing pressure thus obtained according to the working environmental temperature, the ceasing time and the value of classification is set referring to the copy number changing table. For example, in the above-mentioned copy number changing table when the working environmental temperature and the ceasing time are the same, the number of copies is increased as the ink is classified into a class where the volatility and the viscosity of the ink are higher, and when the working environmental temperature and the value of classification are the same, the number of copies is increased as the ceasing time is elongated, and when the ceasing time and the value of classification are the same, the number of copies is increased as the working environmental temperature lowers. And it is possible to set the printing pressure on the basis of a different printing pressure changing table and to print at a different printing pressure after printing of copies in the number of copies thus obtained.

Though, in the stencil printer 1 of the first embodiment of the present invention, the printing pressure is controlled according to the information representing the volatility and the viscosity of ink and the ceasing time, the rotational speed of the printing drum may be controlled according to the information representing the volatility and the viscosity of ink and the ceasing time with the printing pressure held constant. Specifically, since the amount of ink transferred to the printing paper P per unit time is reduced as the volatility and the viscosity of the ink increase, the rotational speed is reduced as the volatility and the viscosity of the ink increase when the ceasing time is the same, and the rotational speed is reduced as the ceasing time is elongated, when the volatility and the viscosity of ink are the same since the amount of ink transferred to the printing paper P per unit time is reduced as the ceasing time is elongated. Further, as in controlling the printing pressure, the number of copies at the rotational speed thus controlled may be controlled. And it is possible to print at a different rotational speed after printing of copies in the number of copies thus obtained.

Though, in the stencil printer 1 of the first embodiment of the present invention, the printing pressure or the rotational speed is controlled according to the information representing the volatility and the viscosity of ink and the ceasing time, it is not necessary to classify inks taking into account both the volatility and the viscosity but the volatility of ink may be solely taken into account when, for instance, the kinds of ink to be employed are substantially the same in viscosity before use and the printing pressure or the rotational speed may be controlled according to the volatility of the ink and the ceasing time. Further, the viscosity of ink may be solely taken into account when the kinds of ink to be employed are substantially the same in volatility and the printing pressure or the rotational speed may be controlled according to the viscosity of the ink and the ceasing time.

Though, in the stencil printer 1 in accordance with the first embodiment described above, the information representing the kind of ink is stored in the memory IC 81 of the storage means 8, the information representing the kind of ink may be recorded as a bar code. Otherwise, the information may be recorded as a letter or a symbol. Further, though in the first embodiment described above, information representing the volatility and the viscosity of the ink is used as the information representing the kind of ink, the kind of ink may be any so long as it affects the permeability of ink to the printing drum 31 and/or the stencil M. For example, it includes those representing the characteristics of change of the viscosity of the ink.

Further, though, in the stencil printer 1 in accordance with the first embodiment described above, the printing pressure changing table such as shown in FIG. 4 or 6 is provided in the printing pressure control means 67 on the printer body side, the table may be stored in the storage means 8 of the ink container 10 so that the printing pressure control means 67 obtains the number of drive pulses by the use of the printing pressure changing table stored in the storage means 8 and outputs the number of drive pulses to the printing pressure adjustment electric motor 124. Further, the copy number changing table such as shown in FIG. 7 need not be provided in the copy number setting means 69 on the printer side but may be stored in the storage means 8 of the ink container 10 so that the copy number setting means 69 obtains the number of copies by the use of the copy number changing table by the use of the copy number changing table stored in the storage means 8.

A stencil printer in accordance with a second embodiment for carrying out the stencil printing method of the present invention will be described, hereinbelow.

Figure 9:
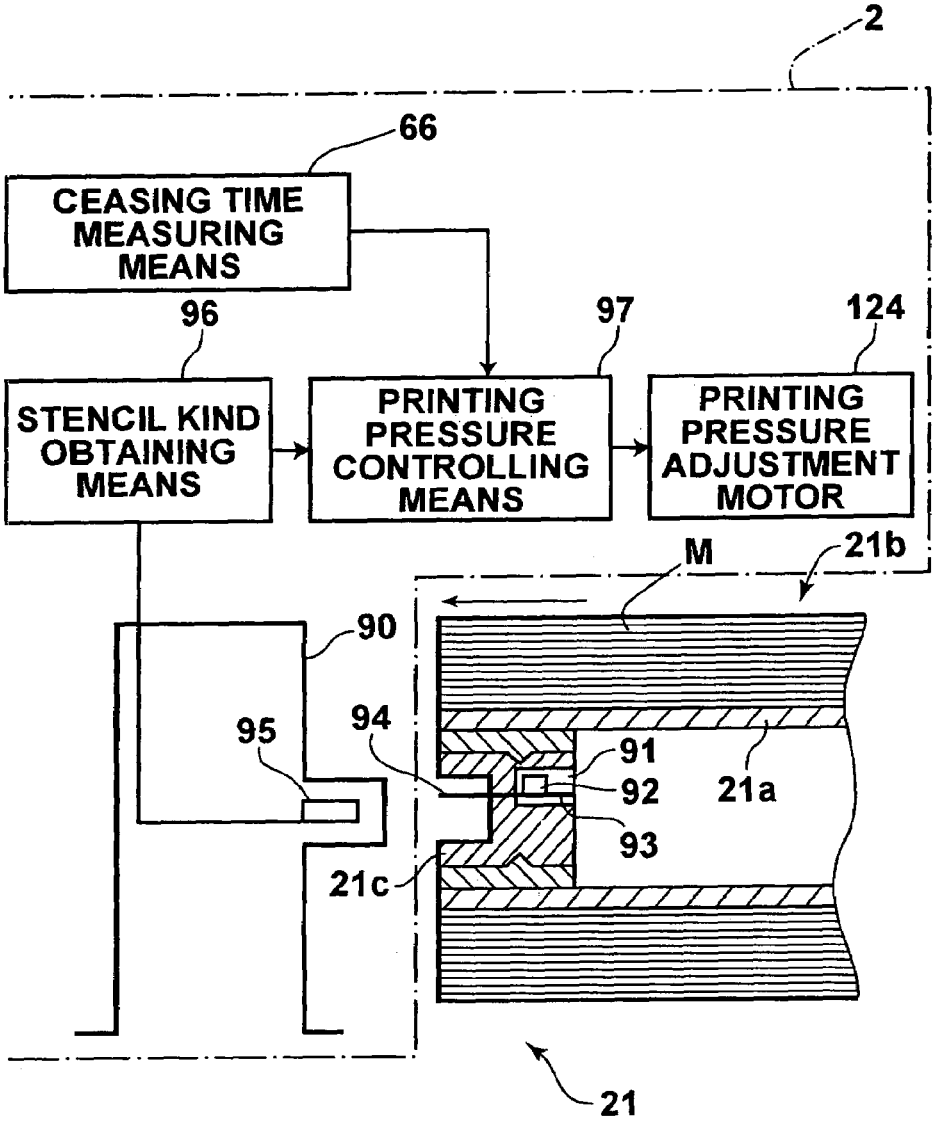
FIG. 9 is a block diagram showing a part of the stencil printer in accordance with a second embodiment of the present invention.

The stencil printer 2 of this embodiment is substantially the same as the stencil printer 1 of the first embodiment shown in FIG. 1 in structure except that in the stencil material roll portion 21, a stencil material roll 21*b* comprising stencil material M in a continuous length wound around a paper core 21*a* is mounted on a master holder 90 to be changeable as shown in FIG. 9. The stencil material M of the stencil material roll 21*b* comprises thermoplastic film and a porous support sheet laminated each other. The material of the porous support sheet includes, for instance, Japanese paper, non-woven fabric, synthetic fibers or synthetic film. The thickness of the porous support sheet is, preferably, 20 to 200.mu.mm more preferably, 30 to 100.mu.m and most preferably, 30 to 60.mu.m. Further, the thermoplastic film may be, for instance, known film such as of polyester, polyamide, polyethylene, polypropylene, polyvinyl chloride, polyvinylidene chloride, copolymers of these compounds, and blends of these compounds. However, polyester, and copolymers or blends of polyester are preferable from the viewpoint of sensitivity to perforation. As the preferred polyester, polyethylene terephthalate, copolymers of ethylene terephthalate and ethylene isophthalate, polyethylene-2,6-naphthalate, polybutyrene terephthalate, copolymers of butyrene terephthalate and ethylene terephthalate, copolymers of butyrene terephthalate and hexamethylene terephthalate, copolymers of hexamethylene terephthalate and 1,4-cyclohexandimethylene terephthalate, copolymers of ethylene terephthalate and ethylene-2,6-naphthalate, and blends of these compounds are included. Further, it is preferred that the thermoplastic film be stretched at least mono-axially. It is more preferred that the thermoplastic film be biaxially oriented film. The thickness of the thermoplastic film is preferably 0.1 to 5 mu.m, more preferably 0.1 to 3.mu.m, and especially preferably 0.5 to 2.mu.m. The thermoplastic film and the porous support sheet of the stencil material M may be bonded with any method so long as they are not un-bonded by a normal handling and the bonding does not obstruct perforation or passing of the ink. As the adhesive, those of vinyl acetate, acryl, copolymers of vinyl chloride and vinyl acetate, polyester, and urethane may be, for instance, used. Ultraviolet curing adhesives such as blends of photopolymerization initiators and polyester acrylates, urethane acrylates, epoxy acrylates, or polyol acrylates may be used. Adhesives including urethane acrylates as a major component is especially preferred. If necessary, additives, e.g., antistatic agents or lubricants, may be added to these compounds.

A storage means 91 which stores information on the void volume of the porous support sheet of the stencil material roll 21*b* is disposed on one end portion of the paper core 21*a* in a support member 21*c* supported for rotation with respect to the paper core 21*a*. The storage means 91 comprises a memory IC 92 forming a non-volatile memory (e.g., an EEPROM) which can hold data for a predetermined time without power supply, and a contact 94 is provided on the tip of a board 93 on which the memory IC 92 is mounted. Further, as shown in FIG. 9, a connector 95 which is to be electrically connected to the contact 94 of the storage means 91 of the stencil material roll 21*b* is provided.

Further, the stencil printer 2 is provided with a stencil material kind obtaining means 96 which is connected to the connector 95 and obtains from the storage means 91 of the stencil material roll 21*b* information representing the void volume of the stencil material M, a ceasing time measuring means 66 which measures a ceasing time from interruption of printing to resumption of the same, and a printing pressure controlling means 97 which controls the printing pressure of the press roller 35 against the printing drum 31 by controlling the printing pressure adjustment electric motor 124 according to the information on the void volume of the stencil material M obtained by the stencil material kind obtaining means 96 and the ceasing time.

A printing pressure changing table such as shown in FIG. 4 described above in conjunction with the first embodiment is stored in the printing pressure controlling means 97. In the printing pressure changing table, a number of drive pulses of the printing pressure adjustment electric motor 124 can be obtained on the basis of information 0-2 representing the void volume of the stencil material M of the stencil material roll 21*b* and the ceasing time. The information 0-2 representing the void volume of the stencil material M is a value representing the class which the ink belongs when the ink are empirically classified in advance according to the void volume of the stencil material M, and one of the values 0 to 2 representing the class of the ink is stored in the storage means 91 of the stencil material roll 21*b*. The printing speed is set in advance by the operator of the system. In the printing pressure changing table, the number of the drive pulses is increased so that the printing pressure at which the press roller 35 is pressed against the printing drum 31 is increased as the void volume of the stencil material M decreases for a given ceasing time. Further, the number of the drive pulses is increased so that the pressure at which the press roller 35 is pressed against the printing drum 31 is increased as the ceasing time increases for a given value of the classification. Though, in this particular embodiment, the numbers of drive pulses are set in the printing pressure changing table, the numbers of drive pulses for standard stencil may be set in advance while ratios to be multiplied or values to be added to or subtracted from the standard value are set in the printing pressure changing table.

Operation of the stencil printer will be described, hereinbelow.

A stencil material roll 21*b* is first mounted on a master holder 90 and the stencil material M is unrolled from the stencil material roll 21*b* in the length of one stencil which has been set in advance. Then, in the stencil making portion 20, a plurality of heater elements of the thermal head 22 are selectively energized to thermally perforate the stencil material M, thereby making a stencil. The stencil is cut by the cutter 28 and is wound around the printing drum 31.

The contact 94 of the storage means 91 of the stencil material roll 21*b* is connected to the connector 9, and the value of the classification stored in the storage means 91 are read out and input into the printing pressure controlling means 97 by the stencil kind obtaining means 96. Further, a ceasing time measured by the ceasing time measuring means 66 is input into the printing pressure controlling means 97. The printing pressure controlling means 97 obtains a number of drive pulses by referring to the printing pressure changing table on the basis of the value of the classification and the ceasing time input, and outputs the number of drive pulses into the printing pressure adjustment electric motor 124. The printing pressure adjustment electric motor 124 is driven on the basis of the number of drive pulses input to control the printing pressure at which the press roller 35 is pressed against the printing drum 31. The operation thereafter is the same as the first embodiment.

In accordance with the stencil printer 2 of the second embodiment of the present invention, since the ceasing time from interruption of printing to resumption of the same is measured and the information on the kind of stencil is obtained so that the printing pressure of the press roller 35 is controlled according to the ceasing time and the kind of stencil, the stencil printing can be made at a stabilized density from the start of printing even if a plurality of kinds of stencils are used in the stencil printer by making the stencil printing at a printing pressure or a rotational speed taking into account both the difference in the kind of stencil and the length of the ceasing time.

Figure 10:
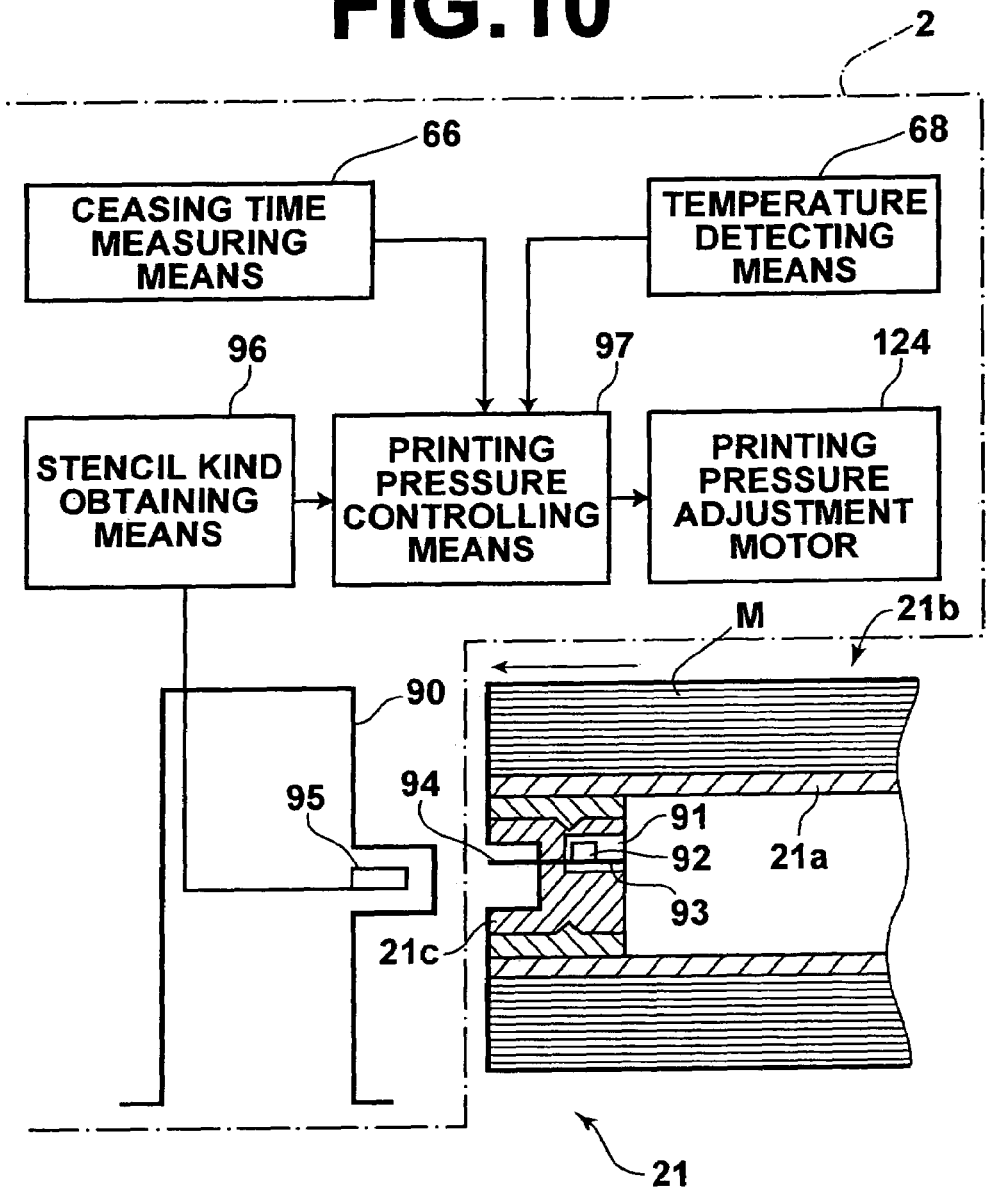
FIG. 10 is a block diagram showing a part of the stencil printer in accordance with a second embodiment of the present invention.

Further, in the stencil printer 2 of the second embodiment of the present invention, it is possible to provide a temperature detecting means 68 which detects the working environmental temperature as shown in FIG. 10 and to store in the printing pressure controlling means 97 a printing pressure changing table on the basis of which a printing pressure can be determined according to the working environmental temperature, the ceasing time and the value of classification so that the printing pressure controlling means 97 obtains a number of drive pulses according to the working environmental temperature detected by the temperature detecting means 68, the ceasing time and the value of classification and the printing pressure adjustment electric motor 124 is driven on the basis of the number of drive pulses.

Figure 11:
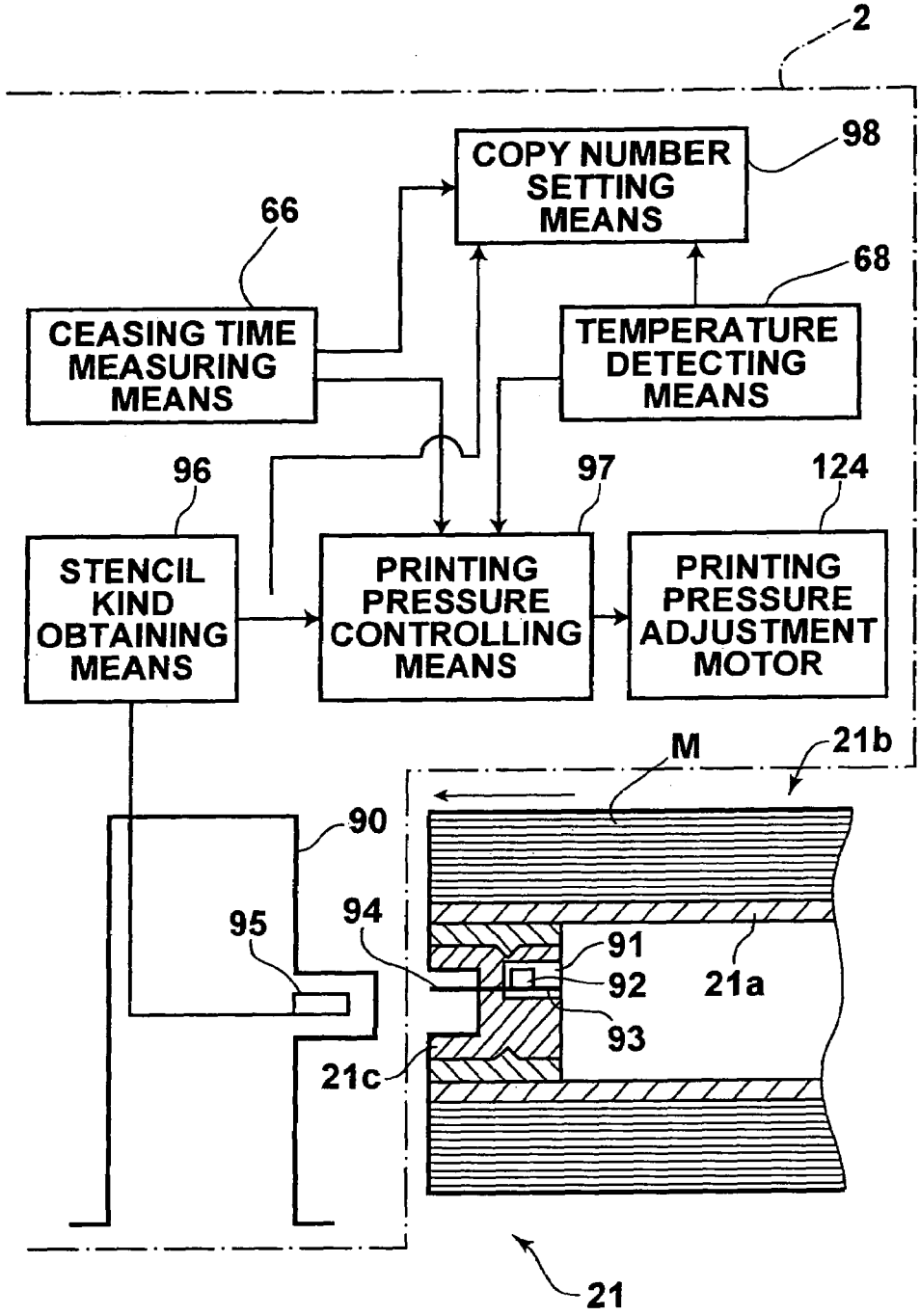
FIG. 11 is a block diagram showing a part of the stencil printer in accordance with a second embodiment of the present invention.

Further, in the stencil printer 2 of the second embodiment of the present invention, it is also possible as in the first embodiment to provide a copy number setting means 98 which stores a copy number changing table such as shown in FIG. 11 on the basis of which a number of copies to be printed can be determined according to the working environmental temperature, the ceasing time and the value of classification so that the number of copies to be printed at the printing pressure thus obtained according to the working environmental temperature, the ceasing time and the value of classification is set referring to the copy number changing table. For example, in the above-mentioned copy number changing table when the working environmental temperature and the ceasing time are the same, the number of copies is increased as the stencil is classified into a class where the void volume of the stencil is lower, and when the working environmental temperature and the value of classification are the same, the number of copies is increased as the ceasing time is elongated, and when the ceasing time and the value of classification are the same, the number of copies is increased as the working environmental temperature lowers. And it is possible to set the printing pressure on the basis of a different printing pressure changing table and to print at a different printing pressure after printing of copies in the number of copies thus obtained.

Though, in the stencil printer 2 of the second embodiment of the present invention, the printing pressure is controlled according to the information representing the void volume of the stencil M and the ceasing time, the rotational speed of the printing drum may be controlled according to the information representing the void volume of the stencil and the ceasing time with the printing pressure held constant. Specifically, since the amount of ink transferred to the printing paper P per unit time is increased as the void volume of the stencil M increases, the rotational speed is increased as the void volume of the stencil increases when the ceasing time is the same, and the rotational speed is reduced as the ceasing time is elongated, when the void volume of the stencil is the same since the viscosity of the ink is increased and the amount of ink transferred to the printing paper P per unit time is reduced as the ceasing time is elongated. Further, as in controlling the printing pressure, the rotational speed may be controlled according to the working environmental temperature. Further, as in controlling the printing pressure, the number of copies at the rotational speed thus controlled may be controlled. And it is possible to print at a different rotational speed after printing of copies in the number of copies thus obtained.

Though, in the stencil printer 2 in accordance with the second embodiment described above, the information representing the void volume of the stencil is stored in the memory IC 92 of the storage means 91, the information representing the void volume of the stencil may be recorded as a bar code. Otherwise, the information may be recorded as a letter or a symbol. Further, though in the second embodiment described above, information representing the void volume of the stencil is used as the information representing the kind of stencil M, information representing the void volume, the void size, the void structure, the thickness, the material and/or the wetting characteristics of the porous support sheet may be used, and it is preferred that it includes at least one of them.

Further, though, in the stencil printer 2 in accordance with the second embodiment described above, the printing pressure changing table is provided in the printing pressure control means 97 on the printer body side, the table may be stored in the storage means 91 of the stencil material roll 21*b* so that the printing pressure control means 97 obtains the number of drive pulses by the use of the printing pressure changing table stored in the storage means 91 and outputs the number of drive pulses to the printing pressure adjustment electric motor 124. Further, the copy number changing table need not be provided in the copy number setting means 98 on the printer side but may be stored in the storage means 91 of the stencil material roll 21*b* so that the copy number setting means 98 obtains the number of copies by the use of the copy number changing table stored in the storage means 91.

Though the printing pressure, the rotational speed or the number of copy is set according to the kind of ink and the ceasing time in the stencil printer 1 of the first embodiment of the present invention and according to the kind of stencil and the ceasing time in the stencil printer 2 of the second embodiment of the present invention, they may be set according to the kind of ink, the kind of stencil and the ceasing time. Specifically, the values of classification used in the first and second embodiments are set on the basis of the kind of ink and the kind of stencil.

The invention claimed is:

1. A stencil printing system comprising a printing drum rotating at a predetermined rotational speed with a stencil wound therearound and a pressing means which presses the printing papers against the outer peripheral surface of the printing drum, wherein stencil printing with ink is accomplished by supplying the ink in the printing drum, pressing each of the printing papers against the printing drum with the stencil made wound therearound at a predetermined printing pressure by the pressing means and rotating the printing drum at the predetermined rotational speed, a ceasing time measuring means which measures a ceasing time from interruption of printing to resumption of the same, a stencil kind obtaining means which obtains information on a kind of stencil, and a printing pressure controlling means which controls the printing pressure of the printing drum according to the ceasing time and the kind of stencil.

2. A stencil printing system as defined in claim 1 further comprising a copy number setting means which sets a number of copies which are made at a printing pressure according to the ceasing time and the kind of stencil according to at least one of information on the ceasing time and information on the kind of stencil.

3. A stencil printing system as defined in claim 1 in which the information on the kind of stencil is information representing the permeability of the ink to the porous support sheet of the stencil.

* * * * *